US006113206A

United States Patent [19]

Melson et al.

[11] Patent Number: 6,113,206

[45] Date of Patent: Sep. 5, 2000

[54] REFRIGERATOR HAVING A REFRIGERATOR SHELF

[75] Inventors: Sabine Melson, Mainz; Roland Leroux, Stadecken-Elsheim; Kurt Leutner, Mainz, all of Germany; Thierry Schleiss, Walscheid, France

[73] Assignee: Schott Glas, Mainz, Germany

[21] Appl. No.: 09/025,000

[22] Filed: Feb. 17, 1998

[30] Foreign Application Priority Data

Feb. 17, 1997 [DE] Germany ..... 197 06 183

[51] Int. Cl.[7] ..... A47B 96/04

[52] U.S. Cl. ..... 312/401; 206/557; 220/608; 312/408

[58] Field of Search ..... 312/408, 410, 312/229, 401; 211/134, 153; 108/24; 206/557; 220/608, 623

[56] References Cited

U.S. PATENT DOCUMENTS

| | | | |
|---|---|---|---|
| 2,006,827 | 7/1935 | Feiler | 206/557 X |
| 3,380,834 | 4/1968 | Janovtchik et al. | 206/557 X |
| 4,123,130 | 10/1978 | Locke . | |
| 4,589,150 | 5/1986 | Sciabarassi | 108/24 X |
| 4,737,182 | 4/1988 | Fecik et al. . | |
| 5,297,669 | 3/1994 | Neuendorf . | |
| 5,403,083 | 4/1995 | Dasher et al. | 312/408 |
| 5,413,035 | 5/1995 | Fernandez | 108/24 X |
| 5,577,823 | 11/1996 | Maglinger | 312/408 X |
| 5,615,798 | 4/1997 | Luburic et al. | 220/608 X |
| 5,878,902 | 3/1999 | Cowan et al. | 220/623 X |

FOREIGN PATENT DOCUMENTS

| | | |
|---|---|---|
| 0683366 | 11/1995 | European Pat. Off. . |
| 9006513 | 9/1990 | Germany . |
| 9006513 U | 9/1990 | Germany . |

*Primary Examiner*—Peter M. Cuomo
*Assistant Examiner*—Stephen Vu
*Attorney, Agent, or Firm*—Nils H. Ljungman & Associates

[57] ABSTRACT

A refrigerator comprising a housing having an interior, a door, an arrangement to cool the interior of the housing, and at least one shelf disposed within the interior of the housing.

18 Claims, 2 Drawing Sheets

REFRIGERATOR HAVING A REFRIGERATOR SHELF

BACKGROUND OF THE INVENTION

1. Field of the Invention:

The present invention relates generally to a refrigerator shelf, in particular, to a shelf made of glass or glass ceramic.

2. Background Information

Refrigerator shelves are generally in the form of grates or transparent panels, whereby the latter have the advantage that the contents of the refrigerator have a more secure surface on which to stand, and that any solid or liquid items which may be spilled do not automatically fall onto the shelves below. On a flat shelf of the type described above, a spilled liquid can spread out over the entire surface before it overflows the edges of the shelf and drips onto the next-lower surface. To create an overflow volume, i.e. a collecting space which retains liquid and prevents it from overflowing, a frame which encircles the edge of the panel and also acts as an edge protector is formed so that it projects beyond the end surface of the edge. Such a configuration can be realized, for example, by means of a plastic molding.

OBJECT OF THE INVENTION

The object of the present invention is to create a refrigerator shelf which has an overflow volume for which no encircling frame constructions or other features are necessary.

SUMMARY OF THE INVENTION

The present invention teaches that this object can be accomplished by an embodiment in which the refrigerator shelf has a convex, concave or curved shape and that its convexity, concavity or curvature is such that the volume over its surface, which volume can be represented by the double integral $$\int_0^y \int_0^x f(x, y)\,dx\,dy,$$

is at least 100 $cm^3$. In addition, starting from the vertex, apex or summit of the convexity, concavity or curvature, the refrigerator shelf has a positive slope or gradient in all directions, which gradient can be represented by $\partial r/\partial\theta>0$.

The shelf can be made of any suitable, desired, generally transparent material. The shelf is preferably made of glass, which glass is preferably tempered or prestressed, or glass ceramic. The advantages of glass or glass ceramic panels for use as refrigerator shelves have long been known. Both of these materials can also be shaped using simple known methods.

The present invention is theoretically not limited to panels of a specified size. However, for use as refrigerator shelves, certain sizes are specified. Larger or smaller panels may be appropriate for other applications of such convex, concave or curved panels, e.g. when the panels are used as shelves in beverage cabinets of other types or as tabletops. Thin, rectangular panels 3 mm–4 mm thick having dimensions of 300 mm×400 mm to 500 mm×700 mm are frequently used for refrigerators. The present invention is also not restricted to panels of a specified shape. "Rectangular" panels, i.e. panels which have a rectangular projection or shape, are the most common, but semi-circular, circular convex or circular curved panels can be used as well (e.g. spherical surface segments).

The shape of the panel, which can be any desired shape, can also be described with sufficient accuracy by the following polynomial $f(x,y)$: $f(x,y)=a_1+a_2y+a_3y^2+a_4x \ldots +a_8x^2y+a_9x^2y^2$ where $a_1 \ldots a_9$ represent coefficients, which coefficients can easily be determined by selected points by a regression. The volume over the surface the "overflow volume", can be described by the double integral.

$$\int_0^y \int_0^x f(x, y)\,dx\,dy.$$

The present invention teaches that this overflow volume should be at least 100 $cm^3$. In addition, the gradient, starting from the vertex of the convexity, concavity or curvature (which vertex has a gradient equal to 0) must be positive in all directions. For a mathematical description of this situation, the function indicted above in Cartesian coordinates must be converted into a polar coordinate function, which conversion can easily be done using a computer. The gradient will then be described by $\partial r/\partial\theta>0$, whereby $\theta$ is the deviation from the angle which describes the vertical or perpendicular.

With an overflow volume of at least 100 $cm^3$, the spilled contents of small containers such as milk cartons can be completely contained by the shelf, so that food in the drawers or shelves below the spill will not be soiled. The convexity, concavity or curvature of the panel required to achieved this overflow volume is a function of the surface area of the panel.

As a result of the gradient, which gradient is always positive, starting from the vertex, the present invention guarantees that the entire overflow volume is available to contain any leaking material. A certain minimum gradient makes it possible to achieve the desired minimum volume with the lowest possible maximum gradients. The gradient should not be too great, however, so that it is still possible to guarantee a secure base for the contents of the refrigerator on the shelf.

In practical terms, the indication of a "total gradient" consists of determining the distance h between the vertex of the convexity and the plane which is drawn through the corner points of the panel, and determining the relationship of this distance to the length of the straight line resulting from the connection of two diagonally opposite corners, i.e. the diagonal D. In conventional refrigerators, the two diagonals are of equal lengths.

Preferably, the distance h should be at least 0.45% of the diagonal D ($h \geqq 2\ 0.0045*D$). On large panels, this requirement, in addition to the overflow volume of 100 $cm^3$, will represent a restriction, while on small panels, this overflow volume can be achieved, so to speak, only with rather steep gradients.

Preferably, the distance h should not exceed 0.9% of the diagonal D ($h \leqq 0.009*D$). With such short diagonals, the bending of the edges is so small that the panel can be placed on mountings just as easily as flat panels. Moreover, an excessive convexity, concavity or curvature of the panel would no longer guarantee a secure base on which the contents could stand.

On highly convex or concave panels, the curvatures of the edges with the moldings which, as described above, are frequently also present on flat plates to create an overflow volume can be flattened out, among other things, which can create a particularly large overflow volume.

The curved refrigerator shelves in an embodiment of the present invention can represent a spherical surface segment or segment of the surface of a sphere. Other geometries are conceivable, however, including those which differ only slightly from "spherical symmetry", such as flattened spherical surfaces or pan-shaped surfaces. Such geometries are easy to realize.

For the special case of a segment of the surface of a sphere, the overflow volume V can easily be calculated with the distance h defined above between the vertex of the convexity or concavity and the plane which is drawn through the corner points of the panel as $V=\frac{1}{3}*s*h$, whereby s represents the surface area of the panel. It is clear that a minimum distance h, which distance varies with the surface area s, is necessary to achieve the desired volume of 100 $cm^3$. The formula indicated above is also altogether sufficient to estimate V for shelves which have only approximately the shape of a segment of the surface of a sphere.

Conventional bending technologies can be used to produce a convex refrigerator shelf, in particular one made of glass. One possible technology is gravity sagging. In this process, the glass panel is introduced into a bending furnace by a horizontal conveyor. The glass panel is positioned pneumatically by a position stamp. The lower element (generally a profile frame) is introduced into the bending station by a truck on wheels. The glass panel is laid on this element and is given its final shape at approximately 620° C. to 660° C., the temperature being determined as a function of the composition of the glass. Other potential technologies include press deformations.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to the exemplary embodiments illustrated in the accompanying drawings, wherein.

DESCRIPTION OF THE PREFERRED EMBODIMENT

Figure 1:
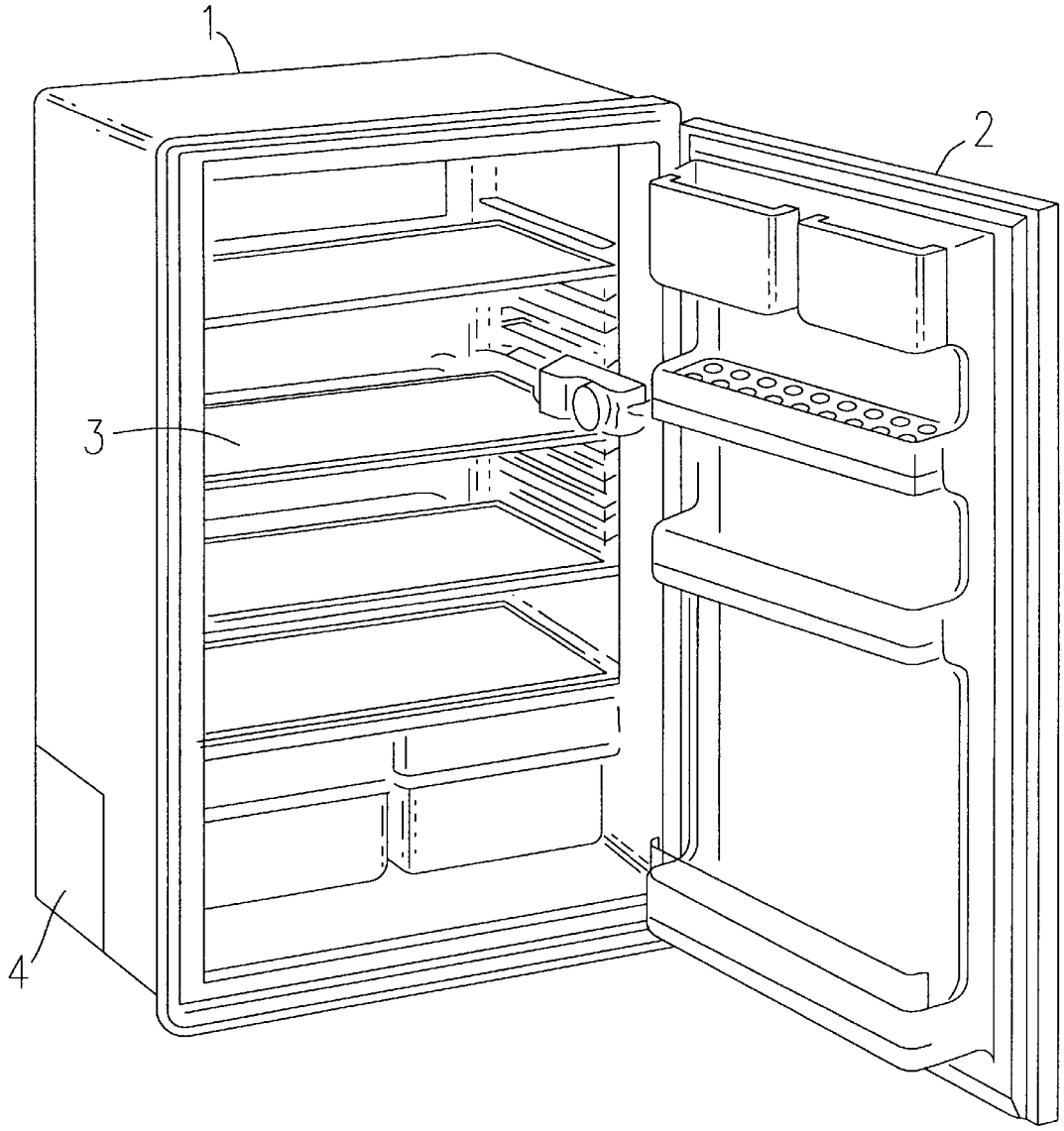
FIG. 1 illustrates a refrigerator with shelving.

FIG. 1 shows in one possible embodiment of the present invention a refrigerator with a housing 1. A door 2 can be attached to the housing 1. Several shelves or panels 3 can be positioned inside the housing 1. The shelves 3 can be used for the storage of items, articles and containers in the housing 1. A cooling arrangement 4 can be used to cool the items stored on the shelves 3 in the housing 1 and to maintain a relatively low temperature in the housing 1. The cooling arrangement 4 can include a motor, compressor, coolant and means for transporting or circulating the coolant.

Figure 2:
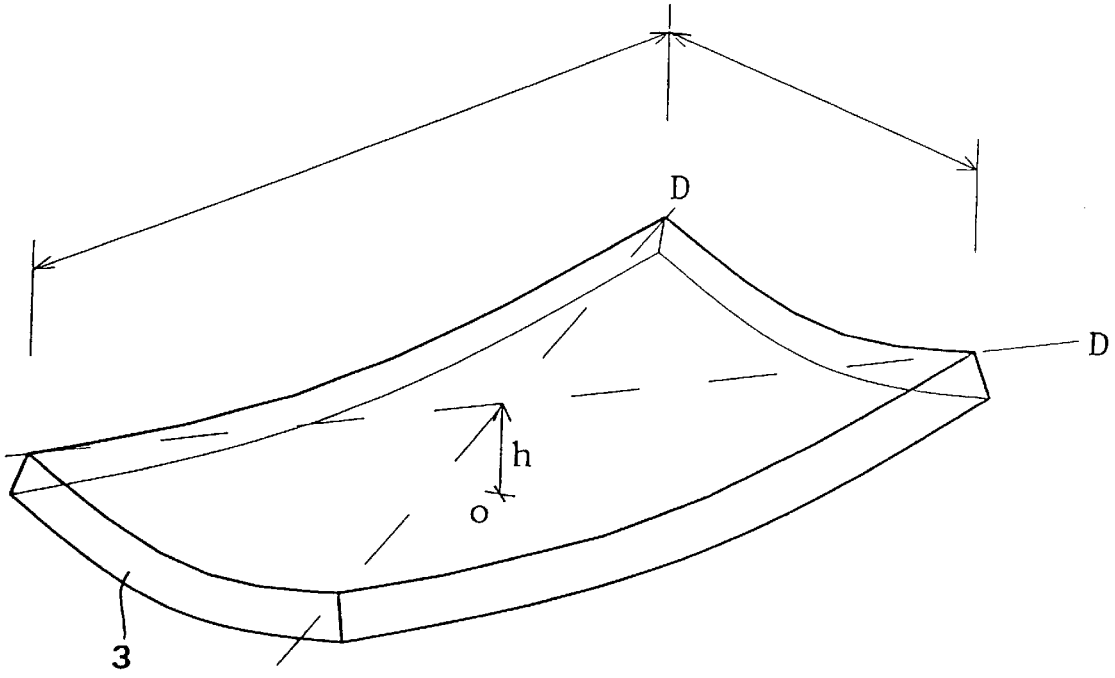
FIG. 2 illustrates a panel, not to scale, in the shape of a segment of the surface of a sphere, whereby the convexity is exaggerated.

In FIG. 2, the distance h from the vertex of the concavity o to the plane drawn through the corner points of the panel 3 is shown, as are the equal-length diagonals D, the length of which diagonals D defines the preferred minimum distance h.

A flat glass panel made of soda-lime glass having the dimensions 400 mm×300 mm×4 mm is preferably shaped using the gravity sagging method into a concave or convex glass panel 3, the height h of which is 2.55 mm. The overflow volume, calculated according to the above formula for segments of the surface of a sphere, is 102 $cm^3$.

The required convexities or concavities are so small that the dimensions a×b of the original flat panel can be used to estimate the overflow volume or h by the surface area, and to determine h by means of D.

In one embodiment of the panel 3, which panel 3 has the dimensions 400 mm×400 mm, the preferred minimum distance h with a diagonal D of 566 mm is 2.55 mm, which distance h corresponds to an overflow volume of 136 $cm^3$.

In another embodiment of the panel 3, which panel 3 has the dimensions 400 mm×500 mm, the preferred minimum distance h with a diagonal D of 640 mm is 2.88 mm, which distance h corresponds to an overflow volume of 192 $cm^3$.

In a further embodiment of the panel 3, which panel 3 has the dimensions 300 mm×420 mm, the minimum overflow volume of 100 $cm^3$ is achieved at a distance h of 2.38 mm.

The present invention makes a panel 3, in particular, a glass or glass ceramic panel, available in a surprisingly simple manner, without additional constructions. The panel 3 has a sufficiently large collecting volume to be excellently suited for use as a refrigerator shelf.

In one possible embodiment of the present invention, the shelf or panel 3 can have a concave surface over at least a portion of the shelf or panel 3. A curved surface and/or a planar surface can extend from the point of concavity or vertex point toward the edges of the panel 3 to form the concave surface. The concave surface of the panel 3 can be designed to hold or retain any substances spilled onto the panel 3.

In another possible embodiment of the present invention, the shelf or panel 3 can have a concave surface over at least a portion of the shelf or panel 3. A curved surface, such as in a bowl, can extend from the point of concavity or vertex point toward the edges of the panel 3 to form the concave surface. The concave surface of the panel 3 can be designed to hold or retain any substances spilled onto the panel 3.

In still another possible embodiment of the present invention, the shelf or panel 3 can have a concave surface over at least a portion of the shelf or panel 3. A compound planar surface, such as a pyramidal surface can extend from the point of concavity or vertex point toward the edges of the panel 3 to form the concave surface. The concave surface of the panel 3 can be designed to hold or retain any substances spilled onto the panel 3.

One feature of the invention resides broadly in the refrigerator shelf, in particular, one made of glass or glass ceramic, characterized by the fact that the shelf has a convex or curved shape and that its convexity curvature is such that the volume omits surface, which can be represented by the double integral $$\int_0^y \int_0^x f(x, y)\,dx\,dy,$$

is at least 100 $cm^3$, and that, starting from the vertex, apex or summit of the convexity, it has a positive slope in all directions, which gradient can be represented by $\partial r/\partial\theta<0$.

Another feature of the invention resides broadly in the refrigerator shelf, in particular, one made of glass or glass ceramic characterized by the fact that the distance h between the vertex of the convexity and the plane which is drawn through or which spans the corner points of the panel is at least 0.45% of the length of the potentially longer of the two straight lines (diagonal D) which lines can be drawn by connecting two diagonally opposite corner points.

Yet another feature of the invention resides broadly in the refrigerator shelf, in particular, one made of glass or glass ceramic characterized by the fact that the distance h is a maximum of 0.9% of the length of the diagonal D.

Still another feature of the invention resides broadly in the refrigerator shelf, in particular, one made of glass or glass ceramic characterized by the fact that it has the shape of the spherical surface segment.

Some examples of refrigerators which may possibly be utilized or adapted for use in the context of the present invention may be disclosed in the following U.S. Pat. No. 5,388,418, issued on Feb. 14, 1995, to Martin et al.; U.S. Pat. No. 5,406,801, issued on Apr. 18, 1995, to Inoue et al.; U.S. Pat. No. 5,421,247, issued on Jun. 6, 1995, to Shim; U.S. Pat. No. 5,425,245, issued on Jun. 20, 1995, to Martin et al.; U.S. Pat. No. 5,433,086, issued on Jul. 18, 1995, to Cho et al.; U.S. Pat. No. 5,440,883, issued on Aug. 15, 1995, to Harada; U.S. Pat. No. 5,460,010, issued on Oct. 24, 1995, to Kobayashi et al.; U.S. Pat. No. 5,463,880, issued on Nov. 7, 1995, to Nishino et al.; U.S. Pat. No. 5,465,591, issued on Nov. 14, 1995, to Cur et al.; and U.S. Pat. No. 5,477,915, issued on Dec. 26, 1995, to Park.

Some examples of glass bending methods and processes which may possibly be utilized or adapted for use in the context of the present invention may be disclosed in the following U.S. Pat. Nos. 5,383,947, issued on Jan. 24, 1995, to Montonen; U.S. Pat. No. 5,393,316, issued on Feb. 28, 1995, to Sugiyama et al.; U.S. Pat. No. 5,437,703, issued on Aug. 1, 1995, to Jacques et al.; U.S. Pat. No. 5,441,551, issued on Aug. 15, 1995, to Ollfisch et al.; U.S. Pat. No. 5,443,609, issued on Aug. 22, 1995, to Lehto; and U.S. Pat. No. 5,472,469, issued on Dec. 5, 1995, to Yli-Vakkuri et al.

Some examples of refrigerator shelving which may be utilized or adapted for use in the context of the present invention may be disclosed in the following U.S. Pat. No. 5,403,083, issued on Apr. 4, 1995, to Dasher et al.; U. S. Pat. No. 5,403,084, issued on Apr. 4, 1995, to Kane et al.; U.S. Pat. No. 5,429,433, issued on Jul. 4, 1995, to Bird et al.; U.S. Pat. No. 5,441,338, issued on Aug. 15, 1995, to Kane et al.; U.S. Pat. No. 5,445,452, issued on Aug. 29, 1995, to Kauffman et al.; and ; U.S. Pat. No. 5,454,638, issued on Oct. 3, 1995, to Bird et al.

Some examples of glass and glass ceramics which may possibly be utilized or adapted for use in the context of the present invention may be disclosed in the following U.S. Pat. No. 5,399,440, issued on Mar. 21, 1995, to Lespade et al.; U.S. Pat. No. 5,403,664, issued on Apr. 4, 1995, to Kurahashi et al.; U.S. Pat. No. 5,407,871, issued on Apr. 18, 1995, to Mizutani et al.; U.S. Pat. No. 5,422,055, issued on Jun. 6, 1995, to Yalvac et al.; and ; U.S. Pat. No. 5,422,318, issued on Jun. 6, 1995 to Hagg et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Pat. Application No. 197 06 183.4-13, filed on Feb. 17, 1997, having inventors Dr. Sabine Melson, Dr. Roland Leroux, Kurt Leutner, and Thierry Schleiss, and DE-OS 197 06 183.4-13 and DE-PS 197 06 183.4-13, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A refrigerator comprising:

a housing having an interior;

a door;

said door being configured and disposed to close said housing and contain the interior of said housing;

an arrangement to cool the interior of said housing;

at least one shelf;

said at least one shelf being disposed within the interior of said housing;

said at least one shelf comprising an upper surface to receive an article to be stored in said refrigerator;

said upper surface of said at least one shelf being concave over substantially all of said upper surface of said at least one shelf; and said concave upper surface of said at least one shelf being configured to provide a sufficient volume to catch and retain a substantially spill of liquid from a container stored in said refrigerator.

2. The refrigerator according to claim 1, wherein said concave upper surface of said at least one shelf is configured to permit articles stored on said at least one shelf to remain substantially vertical and to remain stationary.

3. The refrigerator according to claim 2, wherein the volume of said concave upper surface of said at least one shelf to catch and retain a substantial spill of liquid is at least 100 $cm^3$.

4. The refrigerator according to claim 3, wherein:

said concave upper surface has a vertex; and said concave upper surface is configured to have a positive slope in all directions extending from the vertex.

5. The refrigerator according to claim 4, wherein said at least one shelf comprises a material comprising one of glass and glass ceramic.

6. The refrigerator according to claim 5, wherein:

said at least one shelf comprises four corners;

said four corners of said at least one shelf define a plane extending through said four corners;

the vertex is disposed a first distance from the plane defined by said four corners of said at least one shelf;

the first distance is defined to be substantially transverse to the plane defined by said four corners of said at least one shelf;

said four corners comprise a first corner and a second corner disposed diagonally opposite one another;

said first corner is disposed a second distance from said second corner;

said four corners comprise a third corner and a fourth corner disposed diagonally opposite one another;

said third corner is disposed a third distance from said fourth corner; and the first distance is at least the larger of the second distance multiplied by 0.0045 and the third distance multiplied by 0.0045.

7. The refrigerator according to claim 6, wherein the first distance is no greater than the larger of the second distance multiplied by 0.009 and the third distance multiplied by 0.009.

8. The refrigerator according to claim 7, wherein said at least one shelf is configured to form a substantially spherical surface segment.

9. In a refrigerator according to claim 8, wherein said at least one shelf is formed by one of gravity sagging and press deformation.

10. In a refrigerator comprising a housing having an interior, a door, the door being configured and disposed to close the housing and contain the interior of the housing, an arrangement to cool the interior of said housing;

at least one shelf being disposed within the interior of said housing, said at least one shelf comprising:

an upper surface to receive an article to be stored in said refrigerator;

said upper surface of said at least one shelf being concave over at least a substantially portion of said upper surface of said at least one shelf; and said concave upper surface of said at least one shelf being configured to provide a sufficient volume to catch and retain a substantial spill of liquid from a container stored in the refrigerator.

11. In a refrigerator according to claim 10, wherein:

said upper surface of said at least one shelf is concave over substantially all of said upper surface of said at least one shelf;

said concave upper surface has a vertex; and said concave upper surface is configured to have a positive slope in all directions extending from the vertex.

12. In a refrigerator according to claim 11, wherein the volume of said concave upper surface of said at least one shelf to catch and retain a substantial spill of liquid is at least 100 $cm^3$.

13. In a refrigerator according to claim 12, wherein said at least one shelf comprises a material comprising one of glass and glass ceramic.

14. In a refrigerator according to claim 13, wherein said concave upper surface of said at least one shelf is configured to permit articles stored on said at least one shelf to remain substantially vertical and to remain stationary.

15. In a refrigerator according to claim 14, wherein:

said at least one shelf comprises four corners;

said four corners of said at least one shelf define a plane extending through said four corners;

the vertex is disposed a first distance from the plane defined by said four corners of said at least one shelf;

the first distance is defined to be substantially transverse to the plane defined by said four corners of said at least one shelf;

said four corners comprise a first corner and a second corner disposed diagonally opposite one another;

said first corner is disposed a second distance from said second corner;

said four corners comprise a third corner and a fourth corner disposed diagonally opposite one another;

said third corner is disposed a third distance from said fourth corner; and the first distance is at least the larger of the second distance multiplied by 0.0045 and the third distance multiplied by 0.0045.

16. In a refrigerator according to claim 15, wherein the first distance is no greater than the larger of the second distance multiplied by 0.009 and the third distance multiplied by 0.009.

17. In a refrigerator according to claim 16, wherein said at least one shelf is configured to form a substantially spherical surface segment.

18. In a refrigerator according to claim 17, wherein said at least one shelf is formed by one of gravity sagging and press deformation.

* * * * *

UNITED STATES PATENT AND TRADEMARK OFFICE

CERTIFICATE OF CORRECTION

PATENT NO. : 6,113,206
DATED : September 5, 2000
INVENTOR(S) : Sabine Melson, Roland Leroux, Kurt Leutner, and Thierry Schleiss It is certified that error appears in the above-identified patent and that said Letters Patent is hereby corrected as shown below:

Column 2,
Line 48, after "diagonal D", delete "(h $\geq$ 2" and insert -- (h $\geq$ --.
Line 54, after "diagonal D", delete "(h $\leq$ " and insert -- (h $\leq$ --.

Column 4,
Line 58, after "omits" insert -- over its --
Line 67, after "by", delete "$\partial r/\partial\Theta<0$." and insert -- $\partial r/\partial\Theta>0$. --

Column 6, claim 1,
Line 58, after the first occurrence of "a", delete "substantially" and insert -- substantial --.

Column 7, claim 10,
Line 49, after "a", delete "substantially" and insert -- substantial --.

Signed and Sealed this

Twenty-ninth Day of January, 2002

*Attest:*

*Attesting Officer*

JAMES E. ROGAN
*Director of the United States Patent and Trademark Office*